US008406452B2

(12) United States Patent
Kajihara et al.

(10) Patent No.: US 8,406,452 B2
(45) **Date of Patent: *Mar. 26, 2013**

(54) DIAPHRAGM FOR SPEAKER, SPEAKER USING THE DIAPHRAGM, AND SYSTEM USING THE SPEAKER

(75) Inventors: Yoshimichi Kajihara, Osaka (JP); Kazuaki Nishimura, Mie (JP); Hiroshi Shinkoda, Mie (JP)

(73) Assignee: Panasonic Corporation, Osaka (JP)

( * ) Notice: Subject to any disclaimer, the term of this patent is extended or adjusted under 35 U.S.C. 154(b) by 448 days.

This patent is subject to a terminal disclaimer.

(21) Appl. No.: 12/602,017

(22) PCT Filed: Jul. 8, 2008

(86) PCT No.: PCT/JP2008/001817

§ 371 (c)(1),
(2), (4) Date: Nov. 25, 2009

(87) PCT Pub. No.: WO2009/011102

PCT Pub. Date: Jan. 22, 2009

(65) Prior Publication Data

US 2010/0172533 A1 Jul. 8, 2010

(30) Foreign Application Priority Data

| | | |
|---|---|---|
| Jul. 13, 2007 | (JP) | 2007-183964 |
| Jul. 13, 2007 | (JP) | 2007-183965 |
| Oct. 3, 2007 | (JP) | 2007-259594 |
| Oct. 3, 2007 | (JP) | 2007-259595 |

(51) Int. Cl.
*H04R 11/02* (2006.01)

(52) U.S. Cl. ..... 381/428; 181/169; 523/223

(58) Field of Classification Search ..... 381/398, 381/428, 396, 421; 523/223; 181/169, 170, 181/168, 167

See application file for complete search history.

(56) References Cited

U.S. PATENT DOCUMENTS

| | | | | |
|---|---|---|---|---|
| 2005/0211402 | A1 | 9/2005 | Uryu | |
| 2007/0123611 | A1 | 5/2007 | Hirose | |
| 2007/0131478 | A1 | 6/2007 | Okazaki et al. | |
| 2008/0027158 | A1 * | 1/2008 | Ishida et al. | 523/223 |
| 2009/0080687 | A1 * | 3/2009 | Mimura et al. | 381/428 |

FOREIGN PATENT DOCUMENTS

| | | | |
|---|---|---|---|
| CN | 1715335 | A | 1/2006 |
| EP | 1 612 020 | A2 | 1/2006 |
| EP | 1612020 | A2 | 1/2006 |
| JP | 03120999 | A | 5/1991 |
| JP | 04367198 | A | 12/1992 |
| JP | 2003-253011 | A | 9/2003 |
| JP | 2003253011 | A | 9/2003 |

(Continued)

OTHER PUBLICATIONS

International Search Report for PCT/JP2008/001817, Oct. 28, 2008.

(Continued)

*Primary Examiner* — Davetta W. Goins
*Assistant Examiner* — Amir Etesam
(74) *Attorney, Agent, or Firm* — RatnerPrestia

(57) ABSTRACT

A loudspeaker diaphragm contains polylactic acid, and bamboo charcoal mixed in the polylactic acid. The diaphragm does not affect environment and provides a loudspeaker with high sound quality.

51 Claims, 9 Drawing Sheets

FOREIGN PATENT DOCUMENTS

| | | | |
|---|---|---|---|
| JP | 2005-2174 | A | 1/2005 |
| JP | 2005002174 | A | 1/2005 |
| JP | 2005-146261 | A | 6/2005 |
| JP | 2005-154479 | A | 6/2005 |
| JP | 2005146261 | A | 6/2005 |
| JP | 2005154479 | A | 6/2005 |
| JP | 2005-236497 | A | 9/2005 |
| JP | 2005-260546 | A | 9/2005 |
| JP | 2005260546 | A | 9/2005 |
| JP | 2005269427 | A | 9/2005 |
| JP | 2006-16461 | A | 1/2006 |
| JP | 2007196384 | A | 8/2007 |
| WO | WO-2005054366 | A1 | 6/2005 |

OTHER PUBLICATIONS

Japanese Application Serial No. 2007259595, Office Action mailed Feb. 27, 2012, 3 pgs.

Japanese Application Serial No. 2007259594, Office Action mailed Feb. 27, 2012, 3 pgs.

Japanese Application Serial No. 2007183965, Office Action mailed Feb. 27, 2012, 3 pgs.

Japanese Application Serial No. 2007183964, Office Action mailed Feb. 27, 2012, 3 pgs.

Tono, Tetsuzo, "Chemical Studies on Bamboo Fiber as a Raw Material for Pulp", Bull. Univ. Osaka Pref., Ser. B, vol. 14, (1963), 38 pgs.

* cited by examiner

Fig. 3

| Sample | Specific Gravity | Sound Speed (m/s) | Elastic Modulus (MPa) | Inner Loss |
|---|---|---|---|---|
| Example 1 | 1.27 | 1730 | 3800 | 0.030 |
| Example 2 | 1.25 | 1700 | 3600 | 0.035 |
| Comparative Example 1 | 1.25 | 1550 | 3000 | 0.027 |
| Comparative Example 2 | 1.10 | 1730 | 3300 | 0.033 |

Fig. 8

| Sample | Specific Gravity | Sound Speed (m/s) | Elastic Modulus (MPa) | Inner Loss |
|---|---|---|---|---|
| Example 3 | 1.16 | 1900 | 4190 | 0.040 |
| Comparative Example 3 | 1.25 | 1550 | 3000 | 0.027 |
| Comparative Example 4 | 1.10 | 1730 | 3300 | 0.033 |

Fig. 11

| Sample | Specific Gravity | Sound Speed (m/s) | Elastic Modulus (MPa) | Inner Loss | Plant-Based Content (%) |
|---|---|---|---|---|---|
| Example 4 | 1.24 | 2090 | 5420 | 0.036 | 45 |
| Comparative Example 5 | 1.25 | 1550 | 3000 | 0.027 | 100 |
| Comparative Example 6 | 1.12 | 1890 | 4000 | 0.033 | 0 |

DIAPHRAGM FOR SPEAKER, SPEAKER USING THE DIAPHRAGM, AND SYSTEM USING THE SPEAKER

This application is a U.S. National Phase Application of PCT International Application PCT/JP2008/001817.

TECHNICAL FIELD

The present invention relates to a loudspeaker diaphragm for loudspeaker, a loudspeaker including the diaphragm, and a system, such as an audio appliance and a television receiver including the loudspeaker.

BACKGROUND ART

FIG. 15 is a sectional view of a conventional loudspeaker diaphragm 47 made of resin. Diaphragm 47 is formed by thermally melting resin pellets and injection-molding them with a die. The resin pellets are made of single resin material, such as polypropylene. Furthermore, the resin pellets may be made of different resin to adjust physical properties of the diaphragm, that is, properties of a loudspeaker or a sound quality. If a physical property which can hardly be adjusted with such resin, the property may be adjusted by mixing reinforcing material, such as mica, in the resin pellets, so that properties of the loudspeaker and a sound quality may be adjusted.

Resin of conventional diaphragm 47 mainly contains polypropylene. Polypropylene is material derived from petroleum, and therefore, generates an additional amount of carbon dioxide when it is incinerated and wasted, thus affecting environment.

In order to reduce the affect to environment, the use of polylactic acid that is resin derived from plant has been developed. Patent Document 1 discloses a conventional diaphragm made of polylactic acid.

The conventional diaphragm made of polylactic acid does not have high reliability due to insufficient resistance to heat, and has insufficient strength and low elasticity, having a problem in sound quality.

Patent Document 1: JP2005-260546A

SUMMARY OF THE INVENTION

A loudspeaker diaphragm contains polylactic acid, and bamboo charcoal mixed in the polylactic acid.

The diaphragm does not affect environment and provides a loudspeaker with high sound quality.

BRIEF DESCRIPTION OF THE DRAWINGS

FIG. 3 shows properties of the diaphragm in accordance with Embodiment 1.

FIG. 8 shows properties of the diaphragm in accordance with Embodiment 3.

FIG. 11 shows properties of the diaphragm in accordance with Embodiment 4.

REFERENCE NUMERALS

11 Enclosure (Case)
15A Rear Tray (Case)
24 Magnetic Circuit
28 Voice Coil
67 Loudspeaker Diaphragm
67A Polylactic Acid
67B Bamboo Charcoal
67C Bamboo Fiber
77 Loudspeaker Diaphragm
77A Polylactic Acid
77B Bamboo Fiber
77C Microfibrillated Bamboo Fiber
77D Reinforcing Material
81 Loudspeaker Diaphragm
81A Resin (First Resin)
81B Mica (Natural Mineral)
81C Bamboo Fiber (Plant Fiber)
81D Carbonized Material
81E Resin (Second Resin)
91 Loudspeaker Diaphragm
91A Resin
91B Olefin-Based Resin
91C Base Resin
91D Bamboo Fiber
91E Microfibril of Bamboo Fiber
91F Bamboo Charcoal
91G Reinforcing Material
101 Loudspeaker

DETAILED DESCRIPTION OF PREFERRED EMBODIMENTS

Exemplary Embodiment 1

Figure 1:
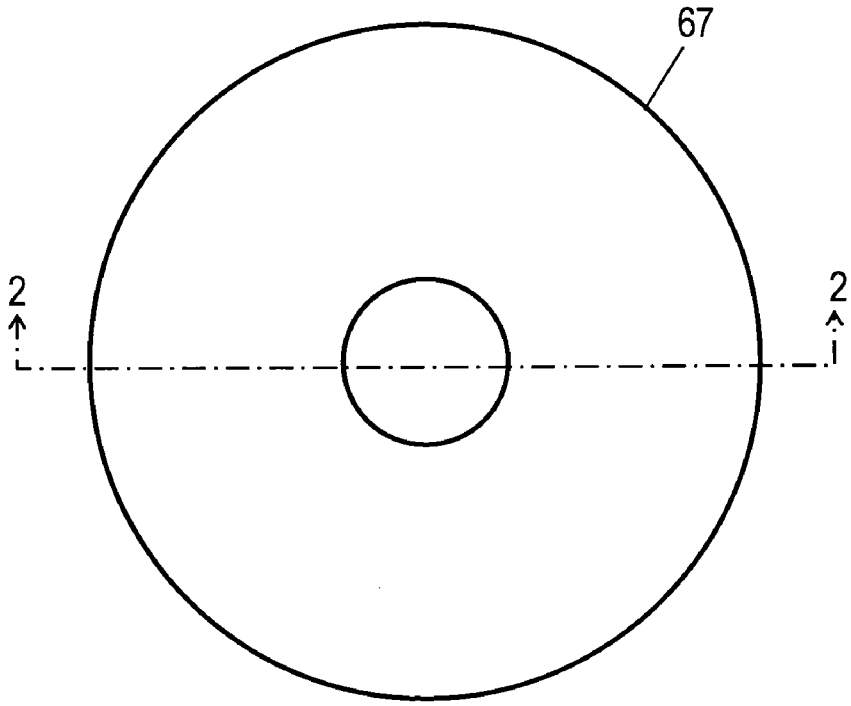
FIG. 1 is a plan view of a loudspeaker diaphragm in accordance with Exemplary Embodiment 1 of the present invention.
Figure 2:
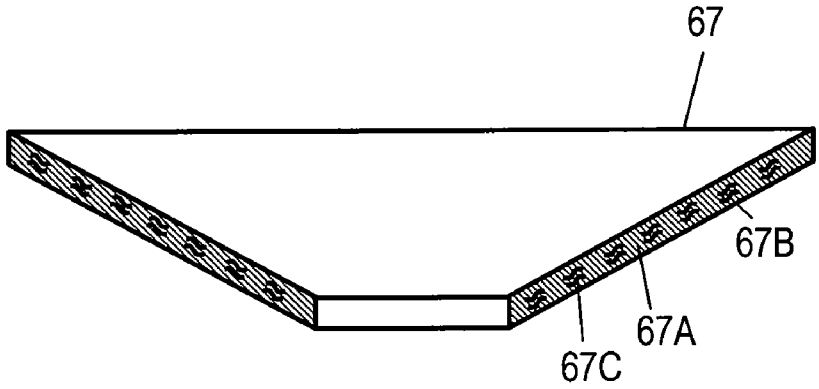
FIG. 2 is a sectional view of the diaphragm at line 2-2 shown in FIG. 1.

FIG. 1 is a plan view of loudspeaker diaphragm 67 in accordance with Exemplary Embodiment 1 of the present invention. FIG. 2 is a sectional view of diaphragm 67 at line 2-2 shown in FIG. 1.

Diaphragm 67 having a conical shape is formed by injection-molding a material including polylactic acid 67A obtained from plant and bamboo charcoal 67B mixed in polylactic acid 67A. Bamboo charcoal 67B is uniformly dispersed in polylactic acid 67A. Bamboo charcoal 67B allows diaphragm 67 to have large resistance to heat. Bamboo charcoal 67B increases the elastic modulus and rigidity, and accordingly, improves the sound quality. Furthermore, bamboo charcoal 67B also functions as a coloring agent for allowing diaphragm 67 to be colored in black and high-quality appearance even without using a pigment.

Bamboo charcoal 67B is granular and is obtained by cutting a bamboo material into an appropriate size, carbonizing the material at a high temperature of about 800° C., and then, pulverizing the carbonized material.

Bamboo fiber 67C may be mixed in order to reduce the weight of diaphragm 67 and increase the elastic modulus of diaphragm 67. Bamboo fiber 67C increases not only the elastic modulus but also the internal loss and increases resistance to heat. The increased internal loss suppresses distortion and resonance. The fiber length of bamboo fiber 67C is not preferably less than 0.2 mm and not more than 3 mm. Bamboo fiber 67C having the fiber length within this range facilitates an effect obtained by mixing polylactic acid 67A and bamboo charcoal 67B efficiently. The fiber length of bamboo fiber 67C shorter than 0.2 mm reduces the effect of bamboo fiber 67C and does not provide a high elastic modulus. The fiber length of bamboo fiber 67C longer than 3 mm may entangle bamboo fibers 67C with each other and produce secondary aggregation, thus preventing bamboo fibers 67C from being easily dispersed. The secondary aggregation necessitates a long time to knead the fibers with polylactic acid 67A to reduce productivity, or deteriorates the appearance due to an aggregated body of bamboo fibers 67C generated on the surface of diaphragm 67.

The content of bamboo fiber 67C is preferably not less than 5 wt. % and not more than 55 wt. %, and more preferably, is not less than 10 wt. % and not more than 30 wt. %. The content of bamboo fiber 67C not more than 5 wt. % reduces the effect of bamboo fiber. The content of the fiber not less than 55 wt. % prevents bamboo fibers 67C from being dispersed uniformly in polylactic acid 67A. In particular, the content of bamboo fiber 67C not less than 30 wt. % reduces the fluidity of polylactic acid 67A, accordingly preventing diaphragm 67 produced by injection-molding from having a thickness not more than 0.3 mm.

Bamboo fiber 67C may be revolved finely to include microfibril. Microfibrillated bamboo fibers 67C are strongly entangled with each other, accordingly increasing the strength of diaphragm 67. This increases the elastic modulus and rigidity of diaphragm 67 and provides high sound quality.

The average fiber diameter of bamboo fiber 67C is preferably not more than 10 μm. In general, a fiber having fiber length L to fiber diameter D has a higher elastic modulus if the fiber has a high aspect ratio L/D of fiber length L to fiber diameter D of the fiber. Microfibrillated bamboo fiber 67C has a high aspect ratio, and provides a high elastic modulus.

In order to obtain more natural and brighter tone by increasing bamboo fibers, bamboo powder may be used for a part or all of the bamboo fibers. The content of bamboo fibers more than 30 wt. % may prevent the diaphragm from being molded easily. However, the bamboo powder used in the bamboo fiber allows diaphragm 67 to be easily molded even when the content of the fibers is more than 30 wt. %. The total content of 55 wt. % of the bamboo powder and the non-powdered bamboo fiber facilitates the injection-molding of diaphragm 67. The content of bamboo fibers more than 50% allows diaphragms 67 to be disposed not in a landfill but to be incinerated and wasted as a bamboo material.

Samples of diaphragm 67 were produced and measured in properties.

Example 1

Materials with 90 wt. % of polylactic acid and 10 wt. % of bamboo charcoal were melted and kneaded so as to produce resin pellets. The resin pellets were injection-molded at a molding temperature of 200° C. as to provide a sample of Example 1 of loudspeaker diaphragm 67 having a diameter of 16 cm.

Example 2

Materials with 80 wt. % of polylactic acid content, 5 wt. % of bamboo charcoal content, and 10 wt. % of bamboo fiber were used to obtain a sample of Example 2 of loudspeaker diaphragm 67 similarly to Example 1.

Comparative Example 1

Only polylactic acid was used to obtain a sample of Comparative Example 1 of a loudspeaker diaphragm similarly to Example 1.

Comparative Example 2

Materials with 80 wt % of polylactic acid and 20 wt. % of mica were used to obtain a sample of Comparative Example 2 of a loudspeaker diaphragm similarly to Example 1.

Specific gravities of the samples of Examples 1 and 2 and Comparative Examples 1 and 2 were measured. Then, sample strips each having a size of 32 mm by 5 mm were taken from the samples, and measured in elastic modulus, inner loss, and sound speed. FIG. 3 shows these measurement results.

FIG. 3 clearly shows that the samples of Examples of diaphragms 67 have sound speed and internal loss better than those of the samples of Comparative Example 1, thus providing a higher sound quality.

The sample of Comparative Example 2 includes polypropylene as conventional resin made from petroleum and 20 wt. % of mica as reinforcing material. The sound speed and the internal loss of diaphragm 67 of Examples 1 and 2 are substantially equal to those of the diaphragm of Comparative Example 2. Diaphragms 67 of Examples 1 and 2 do not include material made from petroleum, thus allowing the loudspeaker to affect environment and to having high sound quality.

Samples of the diaphragms of Examples 1 and 2 and Comparative Examples 1 and 2 were put in a constant-temperature oven at a temperature of 100° C. for 240 hours to be evaluated in resistance to heat.

The sample of Comparative Example 1 deformed and had undulation at an outer peripheral portion of the diaphragm. The samples of Examples 1 and 2 and Comparative Example 2 did not deform.

Exemplary Embodiment 2

Figure 4:
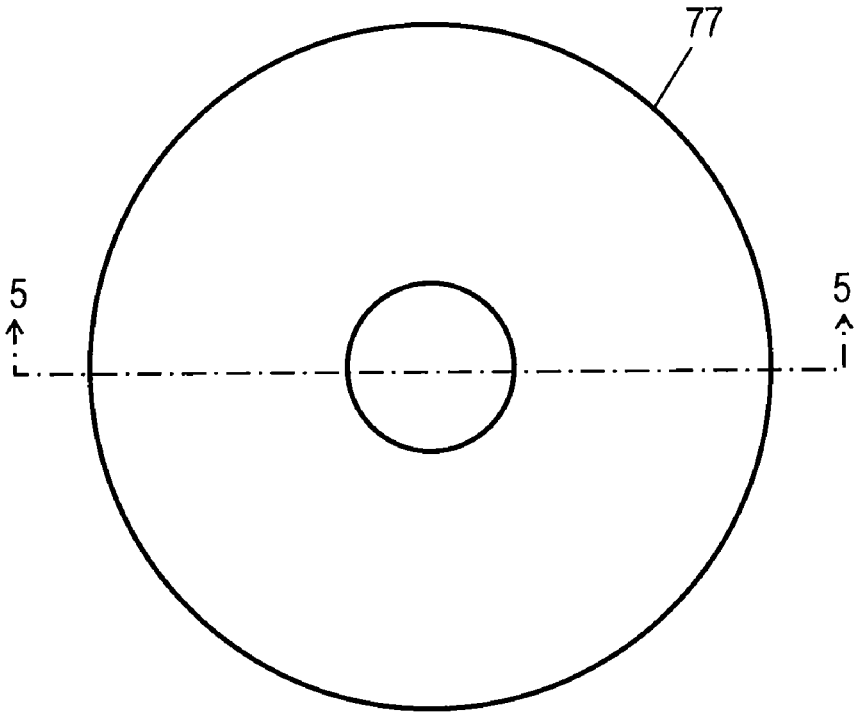
FIG. 4 is a plan view of a loudspeaker diaphragm in accordance with Exemplary Embodiment 2 of the invention.
Figure 5:
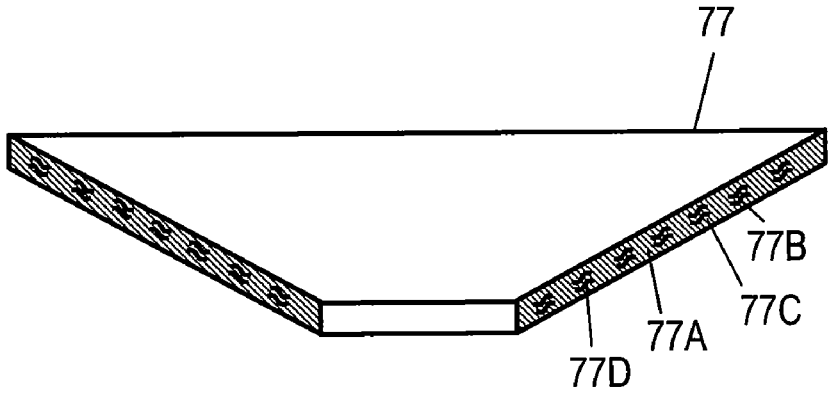
FIG. 5 is a sectional view of the diaphragm at line 5-5 shown in FIG. 4.

FIG. 4 is a plan view of loudspeaker diaphragm 77 in accordance with Exemplary Embodiment 2 of the present invention. FIG. 5 is a sectional view of diaphragm 77 at line 5-5 shown in FIG. 4.

Diaphragm 77 is formed by injection-molding a material including polylactic acid 77A obtained from plant and bamboo fibers 77B and 77C mixed in polylactic acid 77A. Bamboo fibers 77B and 77C are dispersed in polylactic acid 77A uniformly. Bamboo fibers 77C are resolved finely to change into microfibril, and are entangled with each other and entangled with bamboo fibers 77B. This arrangement increases the strength and the elastic modulus of diaphragm 77, accordingly improving the sound quality. Microfibrillated bamboo fiber 77C provides diaphragm 77 with large resistance to heat and high reliability.

The average fiber diameter of bamboo fibers 77C is preferably not more than 10 μm. In general, a fiber having fiber length L to fiber diameter D has a higher elastic modulus when the fiber has a larger aspect ratio L/D, that is, a ratio of fiber length L to fiber diameter D. Microfibrillated bamboo fiber 77C has a high aspect ratio, and accordingly, has a high elastic modulus. Furthermore, bamboo fiber 77C makes the connection between fibers stronger, accordingly providing a higher elastic modulus.

The fiber length of bamboo fiber 77B is preferably not less than 0.2 mm and not more than 3 mm. The fiber length of bamboo fiber 77B within this range effectively facilitates the effects obtained by mixing bamboo fiber 77B with polylactic acid 77A. The fiber length of bamboo fiber 77B shorter than 0.2 mm reduces the effects of bamboo fiber 77B and does not provide a high elastic modulus. On the other hand, the fiber length of bamboo fiber 77B longer than 3 mm causes bamboo fibers 77B to get entangled with each other, thus causing secondary aggregation and preventing bamboo fibers 77B from being dispersed. The secondary aggregation increases a time to kneading with polylactic acid 77A, thus reducing productivity and deteriorating the appearance due to an aggregated body of bamboo fibers 77B generated on the surface of diaphragm 77.

In order to obtain more natural and brighter tone by increasing bamboo fibers 77B, bamboo powders are used as a part of bamboo fibers 77B. The total content of bamboo fibers 77B and 77C more than 35 wt. % necessitates a long time for dispersing bamboo fibers 77B and 77C in polylactic acid 77A uniformly. This prevents bamboo fibers 77B and 77C from being dispersed sufficiently, accordingly reducing effects of bamboo fibers 77B and 77C. This reduces the fluidity of the material containing polylactic acid 77A and bamboo fibers 77B and 77C, accordingly necessitating a long time for injection-molding and reducing productivity of diaphragm 77.

In order to manufacture loudspeaker diaphragm 77 including the total content of bamboo fibers 77B and 77C ranging from 35 wt. % to 60 wt. % by injection-molding with high productivity, bamboo powder is used as bamboo fiber 77B.

The content of bamboo fibers 77B and 77C more than 50 wt. % allows diaphragm 77 to be disposal not in a landfill but to be incinerated and wasted as bamboo material.

Furthermore, the total content of bamboo fibers 77B and 77C is preferably not less than 5 wt. % and not more than 60 wt. %, and more desirably not less than 10 wt. % and not more than 60 wt %. The total content of bamboo fibers 77B and 77C not more than 5 wt % reduces the effect of bamboo fibers 77B and 77C, for example, high resistance to heat.

Reinforcing material 77D can be additionally mixed in polylactic acid 77A in order to strengthen diaphragm 77 for adjusting sound quality, to apply somewhat accent to sound, and to provide sound pressure frequency characteristic with a peak. Reinforcing material 77D can be mica, talc, or graphite. Reinforcing material 77D is preferably made of material made from plant to reduce adverse affection on environment. In this case, bamboo charcoal may be used as reinforcing material 77D. Bamboo charcoal is preferably granular and is obtained by carbonizing bamboo material at a temperature of not less than 800° C. and then pulverizing the carbonized bamboo material. Reinforcing material 77D including granular bamboo charcoal can be easily dispersed in polylactic acid 77A uniformly. Reinforcing material 77D including bamboo charcoal dispersed uniformly in polylactic acid 77A increases the elastic modulus and the internal loss of diaphragm 77, accordingly reducing distortion and resonance and providing high sound quality.

Bamboo charcoal improves resistance to heat and appearance quality of diaphragm 77.

Exemplary Embodiment 3

Figure 6:
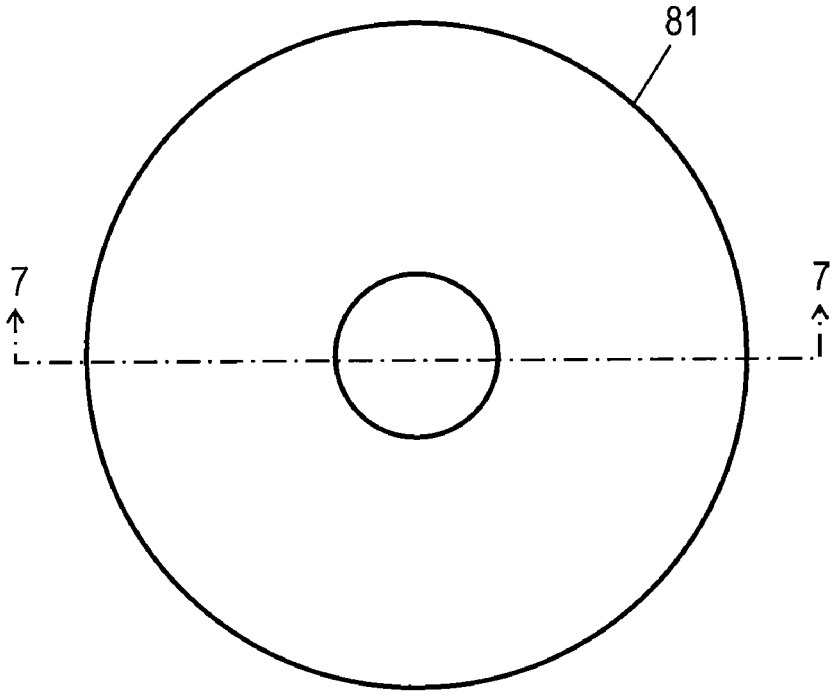
FIG. 6 is a plan view of a loudspeaker diaphragm in accordance with Exemplary Embodiment 3 of the invention.
Figure 7:
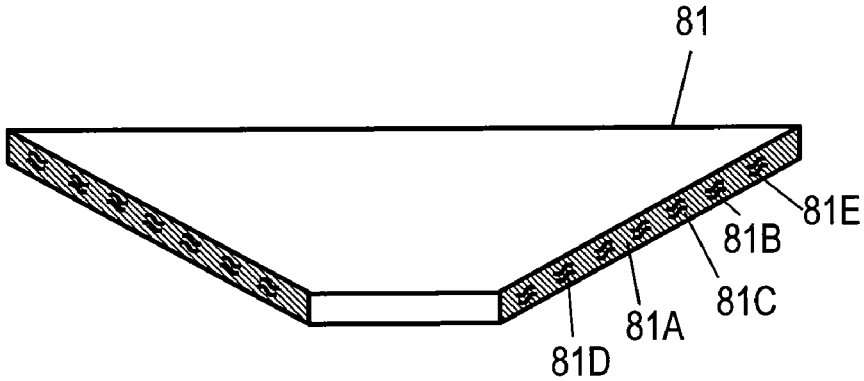
FIG. 7 is a sectional view of the diaphragm at line 7-7 shown in FIG. 6.

FIG. 6 is a plan view of loudspeaker diaphragm 81 in accordance with Exemplary Embodiment 3 of the present invention. FIG. 7 is a sectional view of diaphragm 81 at line 7-7 shown in FIG. 6.

Diaphragm 81 is formed by injection-molding polylactic acid 81A which is resin made from plant, mica 81B as a natural mineral mixed in polylactic acid 81A, and bamboo fiber 81C as plant fiber mixed in polylactic acid 81A. Mica 81B as natural mineral and bamboo fiber 81C as plant fiber are uniformly dispersed in polylactic acid 81A. Mica 81B and bamboo fiber 81C facilitates crystallization of polylactic acid 81A to reduce a time for the injection-molding, and provides diaphragm 81 with large resistance to heat. Bamboo fiber 81C is rigid and flexible, and accordingly increases the elastic modulus and internal loss of diaphragm 81, thus providing diaphragm 81 with high sound quality. The increase of the internal loss suppresses distortion and resonance.

Bamboo has a large deodorizing effect and does not generate an odor peculiar to plant fiber, and hence, can be used for a loudspeaker, such as a vehicle-mounted audio system and an interior audio system, used in a closed space.

Bamboo fiber 81C increases a plant-based content of diaphragm 81 and reduces adverse affection on the environment. The plant-based content means a content of material made from plant. The plant-based content is the total content of polylactic acid 81A as resin made from plant and bamboo fiber 81C as plant fiber contained in diaphragm 81. Upon being incinerated and wasted, diaphragm 81 generates carbon dioxide. Upon being incinerated, material made from petroleum generates carbon dioxide additionally. Since plants absorb carbon dioxide due to photosynthesis, carbon dioxide generated when the plant-derived material is incinerated includes the carbon dioxide absorbed by plants. Therefore, when the material made from plant is incinerated, the amount of carbon dioxide additionally generated can be reduced. Hence, a large plant-based content reduces affection on the environment.

The fiber length of bamboo fiber 81C is preferably not less than 0.2 mm and not more than 5 mm. The fiber length of bamboo fiber 81C shorter than 0.2 mm reduces the effect of bamboo fiber 81C, so that a high elastic modulus cannot be expected. The fiber length of bamboo fiber 81C longer than 5 mm deteriorates the appearance of diaphragm 81 having a small thickness.

The content of bamboo fiber 81C is preferably not less than 5 wt. % and not more than 55 wt. %, and more preferably not less than 10 wt. % and not more than 30 wt. %.

The content of bamboo fiber 81C not more than 5 wt. % does not exhibit the effect of bamboo fiber 81C sufficiently. The content of bamboo fiber 81C not less than 55 wt. % prevents bamboo fibers 81C from easily be dispersed in polylactic acid 81A uniformly.

The content of bamboo fiber 81C not less than 30 wt. % reduces the fluidity of polylactic acid 81A, accordingly diaphragm 81 formed by injection-molding from having a thickness not more than 0.3 mm. Bamboo fiber 81C is preferably resolved finely to include microfibrils having an average fiber diameter not more than 10 μm. The microfibrillated bamboo fibers are strongly entangled with each other, and accordingly, increase the strength and the elastic modulus of diaphragm 81, thus providing high sound quality.

In general, a fiber having fiber length L and fiber diameter D, upon having a high aspect ration L/D, can have a higher elastic modulus. Since the microfibrillated bamboo fiber has a high aspect ratio, diaphragm 81 is expected to have a high elastic modulus. Bamboo fiber 81C including microfibril formed by resolving a part of bamboo fiber 81C finely strengthens the connection between fibers, accordingly increasing the elastic modulus of diaphragm 81.

In order to obtain more natural and brighter tone by increasing bamboo fibers 81C, bamboo powder may be used for a part or all of bamboo fibers 81C. The content of bamboo fibers 81C more than 30 wt. % prevents the diaphragm from being molded easily. The bamboo powder is used for the bamboo fiber allows diaphragm 81 to be easily molded even when the content of the fibers is more than 30 wt. %. The total content of 55 wt. % of the bamboo powder and the non-powdered bamboo fiber facilitates the injection-molding of diaphragm 81.

Being made of material having a large plant-based content, diaphragm 81 does not affect environment. The plant-based content is a total content of polylactic acid 81A that is material made from plant, such as corn, and bamboo fiber 81C as plant fiber. The plant-based content shows whether or not the emission amount of carbon dioxide as greenhouse gas can be reduced.

Diaphragm 81 may further contain carbonized material 81D, thereby further increasing the elastic modulus. Bamboo charcoal can be contained as carbonized material 81D, and increases the elastic modulus of diaphragm 81 while not reducing the plant-based content. The bamboo charcoal functions as carbon-based pigment used in black-color loudspeaker diaphragm as well, and does not only improve the sound quality of diaphragm 81 but also provides diaphragm 81 with high-quality appearance.

The bamboo charcoal is granular and is obtained by cutting a bamboo material into an appropriate size, carbonizing the material at a high temperature of about 800° C., and then, pulverizing the carbonized material.

The diaphragm may further contain resin 81E made from petroleum. Resin 81E is preferably thermoplastic, resin such as polypropylene. Polypropylene itself has a large internal loss and small specific gravity, and accordingly, allows diaphragm 81 to have a light weight and a large internal loss.

Samples of diaphragm 81 were produced and evaluated in properties.

Example 3

25 wt. % of polylactic acid 81A, 15 wt. % of mica 81B, 15 wt. % of bamboo fiber 81C, and 45 wt. % of polypropylene (resin 81E) were melted and kneaded as to produce resin pellets. The resin pellets were injection-molded at a molding temperature of 200° C. to obtain samples of Example 3 of loudspeaker diaphragm 81 having a diameter of 16 cm.

Comparative Example 3

Only polylactic acid was used to obtain a sample of Comparative Example 3 of a loudspeaker diaphragm similarly to Example 3.

Comparative Example 4

85 wt. % of polypropylene and 15 wt. % of mica were used to obtain a sample of Comparative Example 4 of a loudspeaker diaphragm similarly to Example 3.

Specific gravities of the samples of Example 3 and Comparative Examples 3 and 4 were measured. Then, sample strips each having a size of 32 mm by 5 mm were taken from these samples, and were measured in a elastic modulus, an internal loss, and a sound speed. FIG. 8 shows these measurement results.

As shown in FIG. 8, the sample of Example 3 of the loudspeaker diaphragm has a larger sound speed and a larger internal loss than the sample of Comparative Example 3.

The sample of Example 3 of the loudspeaker diaphragm has a larger sound speed and a larger internal loss than the sample of Comparative Example 4 containing polypropylene made from petroleum as an industrial product and mica as reinforcing material.

The samples of Example 3 and Comparative Examples 3 and 4 were put in a constant-temperature oven at a temperature of 100° C. for 240 hours to evaluate resistance to heat.

The sample of Comparative Example 3 deformed and had undulation at an outer peripheral portion of the diaphragm. The samples of Example 3 and Comparative Example 4 did not deform.

Exemplary Embodiment 4

Figure 9:
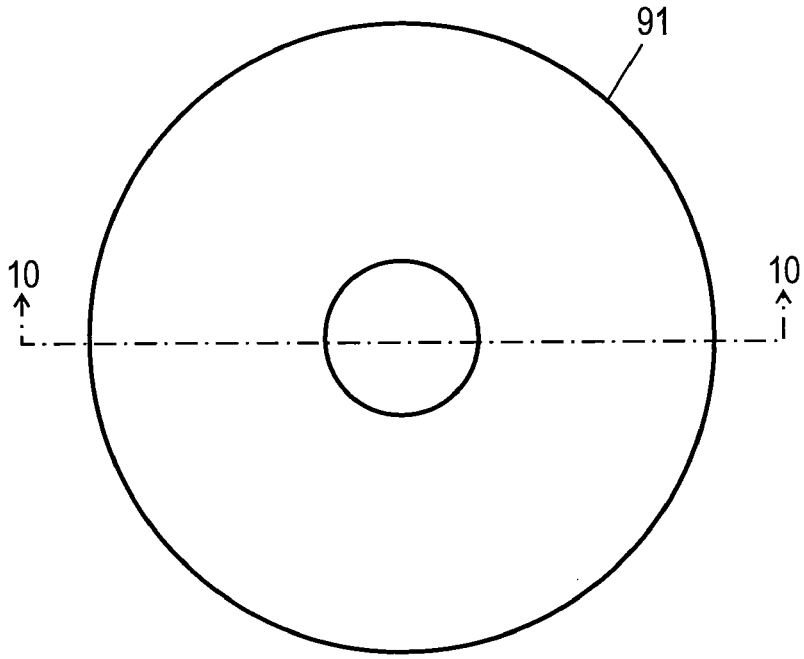
FIG. 9 is a plan view of a loudspeaker diaphragm in accordance with Exemplary Embodiment 4 of the invention.
Figure 10:
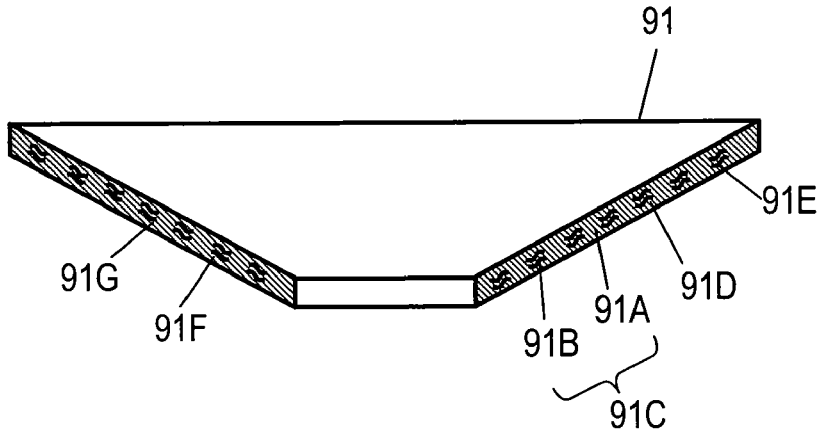
FIG. 10 is a sectional view of the diaphragm at line 10-10 shown in FIG. 9.

FIG. 9 is a plan view of loudspeaker diaphragm 91 in accordance with Exemplary Embodiment 4 of the present invention. FIG. 10 is a sectional view of the diaphragm at line 10-10 shown in FIG. 9.

Diaphragm 91 is formed by injection-molding material including base resin 91C and bamboo fibers 91D dispersed uniformly in base resin 91C.

Base resin 91C is formed by alloying polylactic acid 91A as plant-based resin and polypropylene 91B as olefin resin.

This material provides diaphragm with high resistance to heat. Polypropylene 91B as olefin resin allows the specific gravity of base resin 91C to be smaller than that of polylactic acid 91A. Diaphragm 91 can accordingly be light and increase a sound pressure that is important for acoustic performance. Bamboo fiber 91D increases the elastic modulus and internal loss of diaphragm 91. Diaphragm 91 can be light. A large internal loss suppresses distortion and resonance. Bamboo fiber 91D has a large deodorizing effect and does not generate odor peculiar to plant fiber, thus allowing a loudspeaker used in closed space, such as a vehicle-mounted audio system or an interior audio system.

Bamboo fiber 91C increases a plant-based content of diaphragm 91 and reduces adverse affection on the environment. The plant-based content means a content of material made from plant. The plant-based content is the total content of polylactic acid 91A as resin made from plant and bamboo fiber 91D as plant fiber contained in diaphragm 91. Upon being incinerated and wasted, diaphragm 91 generates carbon dioxide. Upon being incinerated, material made from petroleum generates carbon dioxide additionally. Since plants absorb carbon dioxide due to photosynthesis, carbon dioxide generated when the plant-derived material is incinerated includes the carbon dioxide absorbed by plants. Therefore, when the material made from plant is incinerated, the amount of carbon dioxide additionally generated can be reduced. Hence, a large plant-based content reduces affection on the environment.

The fiber length of bamboo fiber 91D is preferably not less than 0.2 mm and not more than 5 mm. Bamboo fiber 91D having the fiber length within this range exhibit effects obtained by mixing base resin 91C and bamboo fiber 91D efficiently. The fiber length of bamboo fiber 91D shorter than 0.2 mm reduces the effect of bamboo fiber 91D efficiently, so that a high elastic modulus cannot be expected. The fiber length of bamboo fiber 91D longer than 5 mm deteriorates the appearance of diaphragm 91 having a small thickness. Therefore, in order to obtain loudspeaker diaphragm 91 having a high performance and high quality, the fiber length of bamboo fiber 91D is preferably not less than 0.2 mm and not more than 5 mm.

The content of bamboo fiber 91D in diaphragm 91 is preferably not less than 5 wt. % and not more than 55 wt. %, more preferably not less than 10 wt. % and not more than 30 wt. %. The content of bamboo fiber 91D not more than 5 wt. % does not provides the effect of bamboo fiber 91D. The content of bamboo fiber 91D not less than 55 wt. % prevents bamboo fibers 91D from being disperse uniformly in polylactic acid 91. Not less than 30 wt. % of bamboo fiber 91D reduces the fluidity of resin 91C, hence preventing diaphragm 91 from having a thickness not more than 0.3 mm by injection-molding.

Bamboo fiber 91D is preferably resolved finely and allows the diaphragm to further include microfibrillated bamboo fibers 91E having an average fiber diameter not more than 10 μm. The microfibrillated bamboo fiber 91E is entangled with bamboo fiber 91D strongly, and increases the strength and the elastic modulus of diaphragm 91, accordingly providing the diaphragm with higher sound quality.

In general, fiber having fiber length L to fiber diameter D has a high aspect ratio L/D, the ratio of fiber length L to fiber diameter D, and has a large elastic modulus. Microfibrillated bamboo fiber 91E has a high aspect ratio, and accordingly, provides the diaphragm with a high elastic modulus. Microfibrillated bamboo fibers 91E is entangled strongly with bamboo fibers 91D, hence providing diaphragm 91 with a higher elastic modulus.

In order to obtain more natural and brighter tone by increasing bamboo fiber 91D, bamboo powder may be used for a part or all of the bamboo fiber 91D. The content of bamboo fibers more than 30 wt. % may prevent the diaphragm from being molded easily. However, the bamboo powder used in the bamboo fiber allows diaphragm 91 to be easily molded. The total content of 55 wt. % of the bamboo powder and the non-powdered bamboo fiber facilitates the injection-molding of diaphragm 91.

Being made of material having a large plant-based content, diaphragm 91 does not affect environment. The plant-based content is a total content of polylactic acid 91A that is material made from plant, such as corn, and bamboo fiber 91C as plant fiber. The plant-based content shows whether or not the emission amount of carbon dioxide as greenhouse gas can be reduced.

Diaphragm 91 may further contain bamboo charcoal 91F to increase the elastic modulus. Bamboo charcoal 91F also functions as carbon pigment used in a black color loudspeaker diaphragm, and thus, not only improves the sound quality of diaphragm 91 but also provides diaphragm 91 with a high-quality appearance. Bamboo charcoal 91F is granular and is obtained by cutting bamboo material into an appropriate size in advance, carbonizing the material at a temperature of about 800° C., and then pulverizing the carbonized material. Bamboo charcoal 91F, plant fiber, provides diaphragm 91 with high performance and high quality while increasing the plant-based content and reducing adverse affection on environment.

Diaphragm 91 may further contain reinforcing material 91G. Reinforcing material 91G includes natural mineral, such as mica or talc. Mica and talc also function as nucleating agent for facilitating crystallization of polylactic acid 91A and can shorten the time for molding diaphragm 91 and can provide diaphragm 91 with heat resistance to heat.

The reinforcing material can contain polylactic acid. Polylactic acid has a high elastic modulus and high fluidity. Polylactic acid provides loudspeaker diaphragm 91 with a large plant-based content, accordingly reducing affection on environment, and providing high sound quality.

Samples of diaphragm 91 were produced and evaluated in properties.

Example 4

Material containing 30 wt. % of polylactic acid 91A, 30 wt. % of polypropylene 91B, 10 wt. % of bamboo fiber 91D, 5 wt. % of bamboo charcoal 91F, and 25 wt. % of reinforcing material 91G made of mica was melted and kneaded so as to produce resin pellets. The resin pellets were injection-molded at a molding temperature of 200° C. to obtain a sample of Example 4 of loudspeaker diaphragm 91 having a diameter of 16 cm. Example 4 had a plant-based content of 45%.

Comparative Example 5

Material containing only polylactic acid was used to obtain a sample of Comparative Example 5 of a loudspeaker diaphragm similarly to Example 4. Comparative Example 5 had a plant-based content of 100%.

Comparative Example 6

Material containing 75 wt. % of polypropylene and 25 wt. % of mica was used to obtain a sample of Comparative Example 6 of a loudspeaker diaphragm similarly to Example 4. Comparative Example 6 had a plant-based content of 0%.

Specific gravities of the diaphragm samples of Example 4 and Comparative Examples 5 and 6 were measured. Then, sample strips each having a size of 32 mm by 5 mm were taken from these samples, measured in a elastic modulus, an internal loss, and a sound speed. FIG. 11 shows these measurement results.

Example 4 of loudspeaker diaphragm 91 of Example 4 had a higher sound speed and a large internal loss than Comparative Example 5, hence proving the loudspeaker with a higher sound quality.

Example 4 of the loudspeaker diaphragm 91 has a larger sound speed and a larger internal loss than Comparative Example 6 containing polypropylene, resin made from petroleum as industrial product and mica as reinforcing material, Example 4 of diaphragm 91 has a larger plant-based content than Comparative Example 6 provides the loudspeaker with a small affection on environment and a high sound quality.

The samples of the diaphragms of Example 4 and Comparative Examples 5 and 6 were put in a constant-temperature oven at a temperature of 100° C. for 240 hours to evaluate resistance to heat.

The sample of Comparative Example 5 deformed and had undulation at an outer peripheral portion of the diaphragm. The samples of Example 4 and Comparative Example 6 did not deform.

Exemplary Embodiment 5

Figure 12:
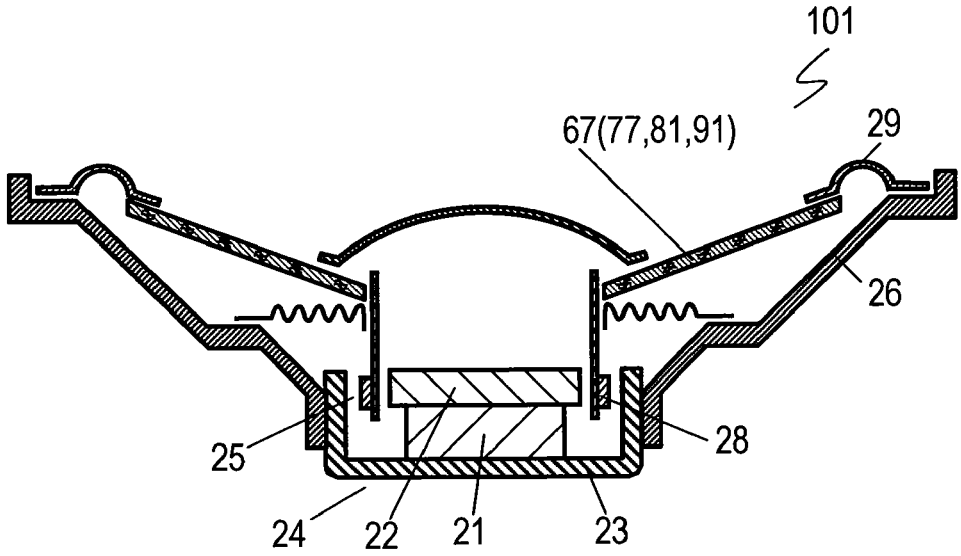
FIG. 12 is a sectional view of a loudspeaker in accordance with Exemplary Embodiment 5 of the invention.

FIG. 12 is a sectional view of loudspeaker 101 in accordance with Exemplary Embodiment 5 of the present invention. Magnetic circuit 24 includes magnet 21, upper plate 22, and yoke 23. Magnet 21 is sandwiched between upper plate 22 and yoke 23. Magnetic circuit 24 is an inner magnetic type magnetic circuit. Frame 26 is connected to yoke 23 of magnetic circuit 24. An outer peripheral portion of diaphragm 67 according to Embodiment 1 is coupled to the peripheral portion of frame 26 via edge 29. An end of voice coil 28 is connected to the central portion of diaphragm 67. Another end of voice coil 28 is located in magnetic gap 25 of magnetic circuit 24. A magnetic flux generated in magnetic circuit 24 crosses voice coil 28. A current flowing in voice coil 28 causes voice coil 28 to vibrated due to the crossing magnetic flux, accordingly causing diaphragm 67 to vibrated as to make a sound.

Loudspeaker 101 may include any one of diaphragms 77, 81, and 91 in accordance with Embodiments 2 to 4 instead of diaphragm 67. Loudspeaker 101 can include an outer magnetic type magnetic circuit instead of inner magnetic type magnetic circuit 24.

Diaphragm 67 (77, 81, 91) prevents loudspeaker 101 from affecting environment and provides the loudspeaker with a high sound quality.

Figure 13:
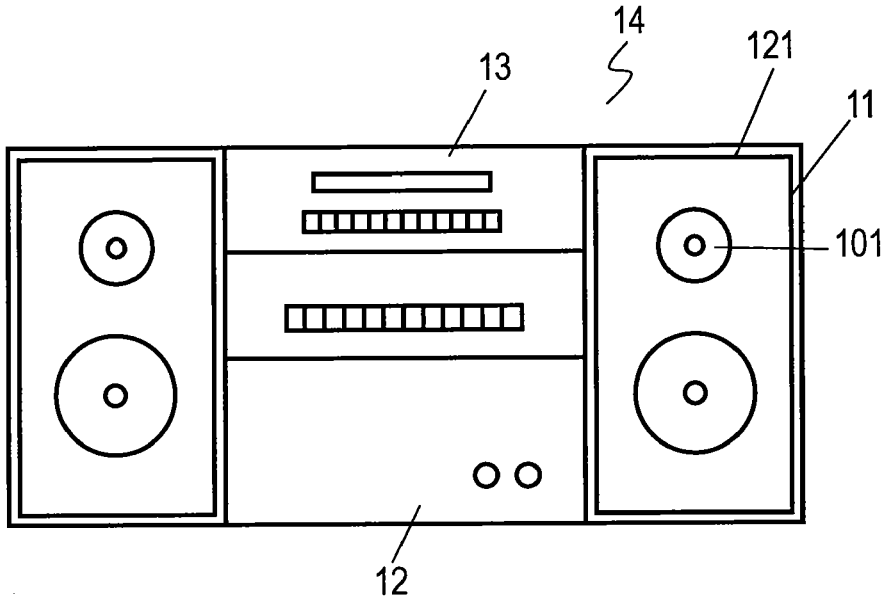
FIG. 13 is a perspective view of a system in accordance with Embodiment 5.

FIG. 13 is a schematic view of audio system 14 in accordance with Exemplary Embodiment 5. Loudspeaker 101 is mounted into enclosure 11, a case, so as to constitute loudspeaker system 121. Amplifier 12 includes an amplifier circuit amplifying an electrical signal input to loudspeaker system 121. Operating section 13, such as a player, outputs a source to be input to amplifier 12. Thus, audio system 14 includes amplifier 12, operating section 13, and loudspeaker system 121. Amplifier 12, operating section 13, and enclosure 11 constitute a main body of audio system 14. That is, loudspeaker 101 is mounted to the main body of audio system 14. Voice coil 28 of loudspeaker 101 is fed from amplifier 12 of the main body and generates a sound from diaphragm 67. Audio system 14 does not affect the environment and has high quality, which is not achieved conventionally.

A system including loudspeaker 101 is not be limited to audio system 14, and can be audio systems and systems for charging thereof, and video systems, such as liquid crystal televisions or plasma display televisions, information communication devices, such as a portable telephone, a computer related device, providing the same effects.

Figure 14:
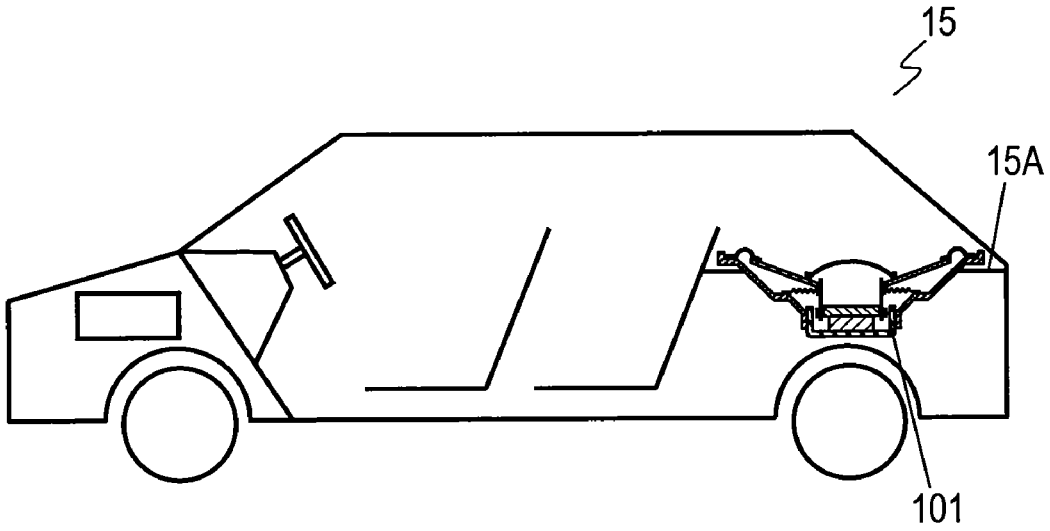
FIG. 14 is a sectional view of another system in accordance with the Embodiment 5.
Figure 15:
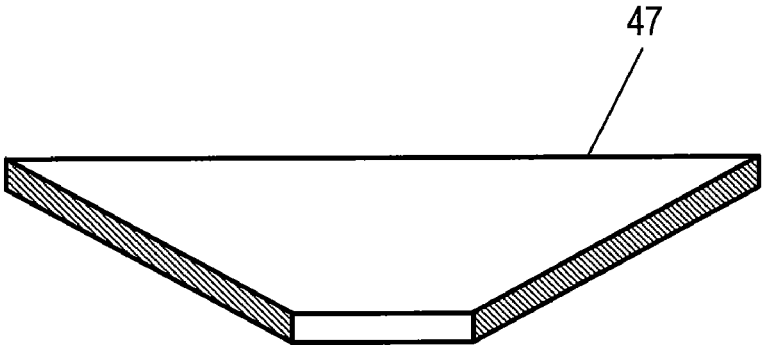
FIG. 15 is a sectional view of a conventional loudspeaker diaphragm.

FIG. 14 is a sectional view of automobile 15, another system in accordance with Embodiment 5. Loudspeaker 101 is mounted to rear tray 15A or a front panel, a case inside automobile 15. Loudspeaker 101 can be used as a part of a car navigation or a car audio system. This configuration prevents automobile 15 from affecting the environment.

INDUSTRIAL APPLICABILITY

A diaphragm according to the present invention does not affect environment and provides a loudspeaker with high sound quality, hence being useful for systems, such as video-audio systems, information communication systems, systems on automobile, which require high sound quality.

The invention claimed is:

1. Loudspeaker diaphragm fibers comprising:

polylactic acid; and bamboo charcoal mixed in the polylactic acid.

2. Loudspeaker diaphragm fibers according to claim 1, further comprising bamboo fiber.

3. Loudspeaker diaphragm fibers according to claim 2, wherein the bamboo fiber has a fiber length not less than 0.2 mm and not more than 3 mm.

4. Loudspeaker diaphragm fibers according to claim 2, wherein a content of the bamboo fiber is not less than 5 wt. % and not more than 55 wt. %.

5. Loudspeaker diaphragm fibers according to claim 2, wherein the bamboo fiber includes microfibrillated bamboo fiber having an average fiber diameter of not more than 10 μm.

6. Loudspeaker diaphragm fibers according to claim 2, wherein the bamboo fiber includes bamboo powder.

7. Loudspeaker diaphragm fibers, comprising:

polylactic acid; and a bamboo fiber mixed in the polylactic acid, wherein the bamboo fiber includes microfibrillated bamboo fiber.

8. Loudspeaker diaphragm fibers according to claim 7, wherein the microfibrillated bamboo fiber has an average fiber diameter not more than 10 μm.

9. Loudspeaker diaphragm fibers according to claim 7, wherein the bamboo fiber has a fiber length not less than 0.2 mm and not more than 3 mm.

10. Loudspeaker diaphragm fibers according to claim 7, wherein the bamboo fiber includes bamboo powder.

11. Loudspeaker diaphragm fibers according to claim 7, wherein a content of the bamboo fiber is not less than 5 wt. % and not more than 60 wt. %.

12. Loudspeaker diaphragm fibers according to claim 7, further comprising reinforcing material.

13. Loudspeaker diaphragm fibers according to claim 7, wherein the reinforcing material contains material made from plant.

14. Loudspeaker diaphragm fibers according to claim 7, wherein the reinforcing material contains bamboo charcoal.

15. Loudspeaker diaphragm fibers, comprising:

first resin made from bamboo fibers, natural mineral mixed in the first resin, plant fiber mixed in the first resin, carbonized material mixed in the first resin, wherein the carbonized material comprises bamboo charcoal.

16. Loudspeaker diaphragm fibers according to claim 15, wherein the first resin comprises polylactic acid.

17. Loudspeaker diaphragm fibers according to claim 15, wherein the natural mineral comprises at least one of mica and talc.

18. Loudspeaker diaphragm fibers according to claim 15, wherein the plant fiber comprises bamboo fiber.

19. Loudspeaker diaphragm fibers according to claim 18, wherein the bamboo fiber has a fiber length not less than 0.2 mm and not more than 5 mm.

20. Loudspeaker diaphragm fibers according to claim 18, wherein a content of the bamboo fiber is not less than 5 wt. % and not more than 55 wt. %.

21. Loudspeaker diaphragm fibers according to claim 18, wherein the bamboo fiber comprises microfibrillated bamboo fiber having an average diameter not more than 10 μm.

22. Loudspeaker diaphragm fibers according to claim 18, wherein the bamboo fiber contains bamboo powder.

23. Loudspeaker diaphragm fibers according to claim 15, further comprising second resin made from petroleum.

24. Loudspeaker diaphragm fibers according to claim 23, wherein the second resin includes thermoplastic resin.

25. Loudspeaker diaphragm fibers according to claim 24, wherein the second resin comprises polypropylene.

26. Loudspeaker diaphragm fibers comprising:

base resin including resin made from bamboo fibers, and olefin resin; and bamboo fiber mixed in the base resin, a carbon charcoal mixed in the base resin.

27. Loudspeaker diaphragm fibers according to claim 26, wherein the resin comprises polylactic acid.

28. Loudspeaker diaphragm fibers according to claim 26, wherein the olefin resin comprises polypropylene.

29. Loudspeaker diaphragm fibers according to claim 26, wherein the bamboo fiber has a fiber length not less than 0.2 mm and not more than 5 mm.

30. Loudspeaker diaphragm fibers according to claim 26, wherein a content of the bamboo fiber is not less than 5 wt. % and not more than 55 wt. %.

31. Loudspeaker diaphragm fibers according to claim 26, wherein the bamboo fiber contains microfibrillated bamboo fiber having an average fiber diameter not more than 10 μm.

32. Loudspeaker diaphragm fibers according to claim 26, wherein the bamboo fiber includes bamboo powder.

33. Loudspeaker diaphragm fibers according to claim 26, further comprising reinforcing material mixed in the base resin.

34. Loudspeaker diaphragm fibers according to claim 33, wherein the reinforcing material is natural mineral.

35. Loudspeaker diaphragm fibers according to claim 34, wherein the reinforcing material is one of mica and talc.

36. Loudspeaker diaphragm fibers according to claim 33, wherein the reinforcing material comprises polylactic acid.

37. A loudspeaker diaphragm comprising the loudspeaker diaphragm fibers according to claim 1.

38. A loudspeaker diaphragm comprising the loudspeaker diaphragm fibers according to claim 2.

39. A loudspeaker diaphragm comprising the loudspeaker diaphragm fibers according to claim 7.

40. A loudspeaker diaphragm comprising the loudspeaker diaphragm fibers according to claim 15.

41. A loudspeaker diaphragm comprising the loudspeaker diaphragm fibers according to claim 26.

42. A loudspeaker comprising:

a loudspeaker diaphragm according to claim 37; a voice coil connected to the loudspeaker diaphragm; and a magnetic circuit for generating a magnetic flux crossing the voice coil.

43. A system comprising:

a loudspeaker according to claim 42; and a case having the loudspeaker mounted thereto.

44. A loudspeaker comprising:

a loudspeaker diaphragm according to claim 39; a voice coil connected to the loudspeaker diaphragm; and a magnetic circuit for generating a magnetic flux crossing the voice coil.

45. A loudspeaker comprising:

a loudspeaker diaphragm according to claim 40; a voice coil connected to the loudspeaker diaphragm; and a magnetic circuit for generating a magnetic flux crossing the voice coil.

46. A loudspeaker comprising:

a loudspeaker diaphragm according to claim 41; a voice coil connected to the loudspeaker diaphragm; and a magnetic circuit for generating a magnetic flux crossing the voice coil.

47. A loudspeaker comprising:

a loudspeaker diaphragm according to claim 38; a voice coil connected to the loudspeaker diaphragm; and a magnetic circuit for generating a magnetic flux crossing the voice coil.

48. A system comprising:

a loudspeaker according to claim 47; and a case having the loudspeaker mounted thereto.

49. A system comprising:

a loudspeaker according to claim 45; and a case having the loudspeaker mounted thereto.

50. A system comprising:

a loudspeaker according to claim 44; and a case having the loudspeaker mounted thereto.

51. A system comprising:

a loudspeaker according to claim 46; and a case having the loudspeaker mounted thereto.

* * * * *